US008001910B2

(12) United States Patent
Yee et al.

(10) Patent No.: US 8,001,910 B2
(45) Date of Patent: Aug. 23, 2011

(54) HOLLOW CORE GLUE LAMINATED FURNITURE

(75) Inventors: Maria Yee, Santa Cruz, CA (US); Hua Xie, Guangzhou (CN)

(73) Assignee: Maria Yee, Inc., Scotts Valley, CA (US)

( * ) Notice: Subject to any disclaimer, the term of this patent is extended or adjusted under 35 U.S.C. 154(b) by 445 days.

(21) Appl. No.: 12/357,354

(22) Filed: Jan. 21, 2009

(65) Prior Publication Data

US 2009/0277129 A1 Nov. 12, 2009

(30) Foreign Application Priority Data

May 8, 2008 (CN) ..... 2008 2 0114950 U

(51) Int. Cl.
*A47B 13/00* (2006.01)

(52) U.S. Cl. ..... 108/157.15; 108/157.18; 108/158.12

(58) Field of Classification Search ..... 108/153.1, 108/157.1, 157.15–157.16, 157.18, 158.12; 403/401, 171, 176, 169; 52/793.11, 783.1, 52/797.1, 792.1; 312/108, 111, 263
See application file for complete search history.

(56) References Cited

U.S. PATENT DOCUMENTS

| | | | | |
|---|---|---|---|---|
| 2,399,666 | A * | 5/1946 | Een | 52/783.13 |
| 3,870,390 | A * | 3/1975 | Herrmann | 108/158.12 |
| 4,290,371 | A * | 9/1981 | Snitzer et al. | 108/158.12 |
| 4,902,164 | A * | 2/1990 | Sauder | 403/401 |
| 5,157,892 | A * | 10/1992 | Ryther | 52/793.11 |
| 5,370,064 | A * | 12/1994 | Sgabellone | 108/157.14 |
| 6,817,153 | B2 * | 11/2004 | Steinberg et al. | 403/401 |
| 7,401,442 | B2 * | 7/2008 | Clark et al. | 52/783.1 |
| 2003/0218407 | A1 * | 11/2003 | Chen | 312/263 |
| 2006/0214493 | A1 * | 9/2006 | Yee | 297/445.1 |

* cited by examiner

*Primary Examiner* — Hanh V Tran
(74) *Attorney, Agent, or Firm* — Haynes & Boone, LLP.

(57) ABSTRACT

A hollow core article of gluelam wood or engineered bamboo furniture, such as bench or table, includes a horizontal main panel (1) and a pair of vertical side panels (2) having upper ends respectively connected to opposite ends of the main panel (1) to support it. The main panel (1) includes a main framework (11), an upper plate (12) disposed on ledges (1115) on an upper surface of the mainframe work (11), and a lower plate (13) having edges disposed on ledges (1116) on a lower surface of the main framework (11). Each of the side panels (2) includes a side framework (21), an outer support plate (22) having edges disposed on ledges (2116) and (2115) on an outer surface of the side framework (21), and an inner support plate (23) having edges disposed on ledges (2116) and (2115) on an inner surface of the side framework (21).

8 Claims, 4 Drawing Sheets

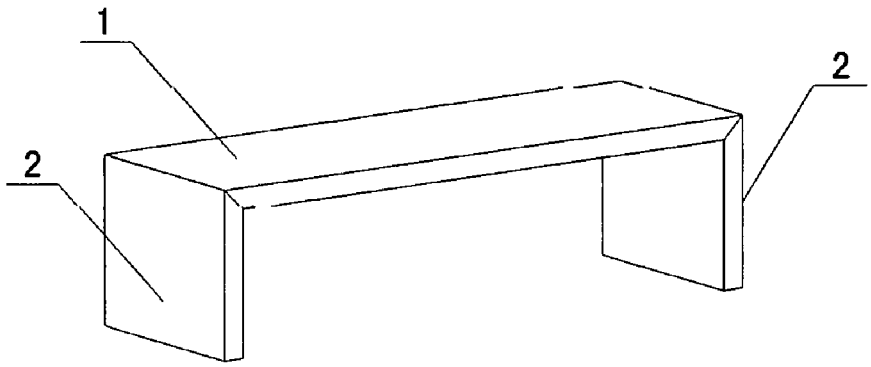
*Fig. 1 - Prior Art*
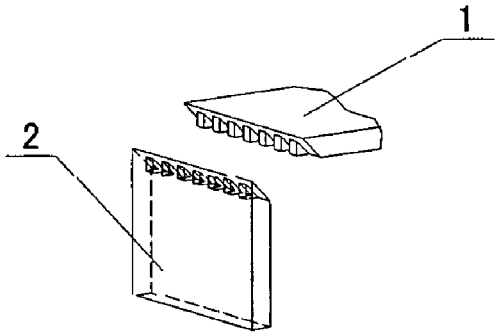
*Fig. 2 - Prior Art*
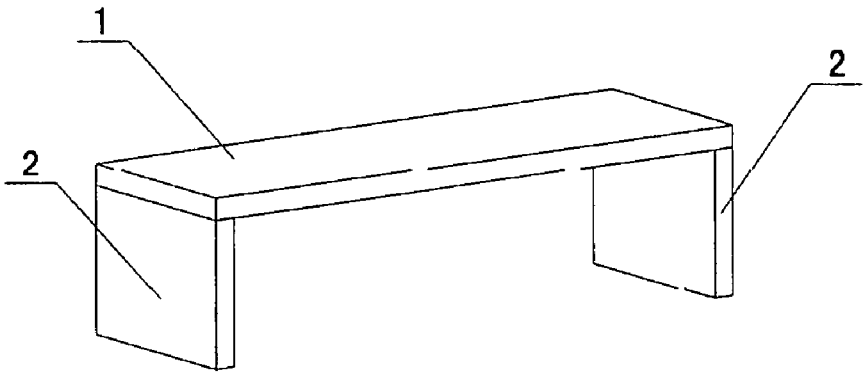
*Fig. 3 - Prior Art*

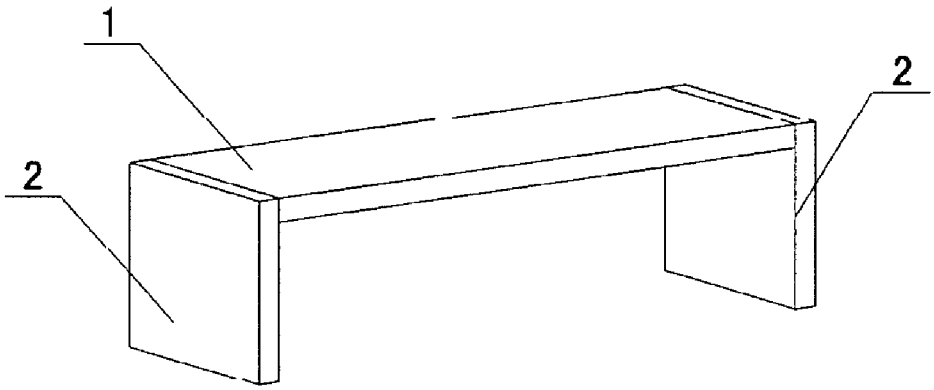
*Fig. 4 - Prior Art*
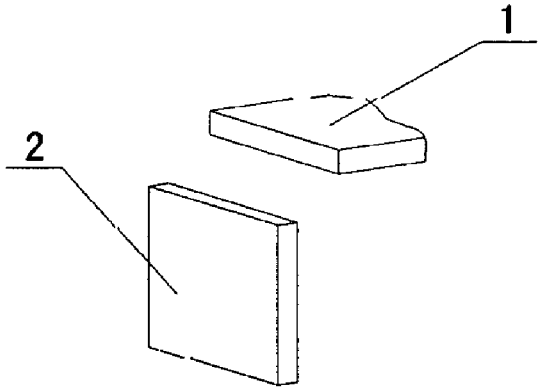
*Fig. 5 - Prior Art*
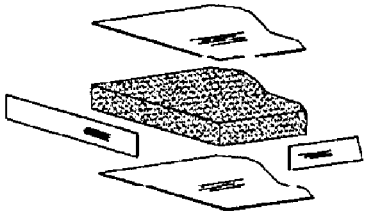
*Fig. 6 - Prior Art*

HOLLOW CORE GLUE LAMINATED FURNITURE

RELATED APPLICATIONS

This application claims priority of Chinese Patent Application No. 200820114950.7, filed May 8, 2008, the entire disclosure of which is incorporated herein by reference.

BACKGROUND

1. Technical Field

The present invention relates to the manufacture of furniture, in general, and in particular to the manufacture of hollow core glue-laminated (gluelam) wood and bamboo furniture articles.

2. Related Art

As illustrated in FIGS. 1 and 2, prior art solid core furniture articles, such as desks or tables, that use side plates acting as vertical support legs typically include two structures, viz., a main panel 1 and two side panels 2 disposed vertically with respect to the main panel 1 and coupled to its opposite ends, all of which are made of solid wood or solid glue-laminated or "engineered" bamboo. As illustrated in FIG. 2, in higher quality designs, the main panel 1 and side panels 2 may be joined to each other by a mortise and tenon joint.

Furniture incorporating such structure results in a substantial waste of the wood or bamboo construction materials, and is usually too heavy to be moved conveniently as a entire set. Additionally, as illustrated in FIGS. 3 to 6, each of the main panel 1 and side panels 2 of the furniture typically comprises an artificial board (e.g., a medium density fiber board, particle board, chip board, or the like) used as a substrate, on which decorative sheets are typically laminated. These decorative sheets may comprise wood or bamboo veneers, papers printed with wood grain graphics, melamine impregnated papers, or the like.

Further, in some less expensive designs, the main panel 1 and side panels 2 are typically butt-joined, as illustrated in FIGS. 3 and 4, using metal or plastic hardware connectors and fasteners, rather than by mortise and tenon joints. While such construction is suitable for portable take apart panel furniture, the furniture remains heavy because of its solid construction, and is not environmentally friendly because of its high formaldehyde content, due to the high glue content of the artificial fiber or particle board substrates used therein. Also, such structures tend to be flimsy, easy to loosen, nondurable, and therefore, impractical.

SUMMARY

In accordance with the present invention, hollow core gluelam wood or engineered bamboo furniture articles are provided that overcome the above disadvantages of the prior art furniture articles, and furniture that is light weight, strong, and makes more efficient use of construction materials.

In one embodiment, a hollow core article of furniture comprises a main panel and a pair of side panels having upper ends respectively connected to opposite ends of the main panel. The main panel includes a main framework, an upper plate having front and rear edges respectively disposed on corresponding front and rear ledges on an upper surface of the main framework, and a lower plate having front and rear edges respectively disposed on corresponding front and rear ledges on a lower surface of the main framework. Each of the side panels includes a side framework, an outer support plate having front and rear edges respectively disposed on corresponding front and rear ledges on an outer surface of the side framework, and an inner support plate having front and rear edges respectively disposed on corresponding front and rear ledges on an inner surface of the side framework.

The main framework may comprise a rectangular frame formed by connecting opposite ends of a pair of elongated transverse frame borders to corresponding opposite ends of a pair of elongated longitudinal frame borders, each of which has an L-shaped cross-section defining a pair of orthogonal vertical and horizontal legs, and at least one elongated longitudinal support beam extending orthogonally between the two transverse frame borders intermediate their opposite ends. The at least one support beam has opposite ends respectively connected to corresponding ones of the transverse frame borders, e.g., by respective mortise and tenon joints. The side framework may comprise a U-shaped frame formed by connecting respective lower ends of a pair of elongated vertical frame borders to corresponding opposite ends of an elongated longitudinal lower frame border.

Each of the opposite ends of each of the transverse frame borders is sloped at a 45 degree angle, and includes a mortise with a tenon extending therefrom. Each of the vertical frame borders includes an upper end that is sloped at an angle corresponding to the angle on a corresponding end of a corresponding one of the transverse frame borders, and includes a mortise into which the tenon at the corresponding end of the corresponding transverse frame border extends. Each of the opposite ends of each of the L-shaped longitudinal frame borders includes a pair of mortises, each having a respective tenon extending therefrom. The tenons respectively extend into corresponding mortises respectively formed in the sides of the transverse frame borders at the opposite ends thereof and in the sides of the vertical frame borders at the upper ends thereof. Each of the opposite ends of the longitudinal lower frame border includes a mortise having a tenon extending therefrom, and the tenons extend into corresponding mortises respectively formed in the sides of the vertical frame borders at the lower ends thereof.

A better understanding of the above and many other features and advantages of the novel hollow core furniture articles of the present invention may be obtained from a consideration of the detailed description of some example embodiments thereof below, particularly if such consideration is made in conjunction with the appended drawings, wherein like reference numerals are used to identify like elements illustrated in one or more of the figures thereof.

BRIEF DESCRIPTION OF THE DRAWINGS

FIG. 1 is a perspective view of an example embodiment of a solid core table or desk made of wood or glue-laminated bamboo in accordance with the prior art;

FIG. 2 is a partial exploded perspective view of a mortise and tenon joint of the prior art furniture article of FIG. 1;

FIG. 3 is a perspective view of another example embodiment of a solid core table or desk incorporating artificial board substrates having decorative sheets laminated on their outer surfaces in accordance with the prior art;

FIG. 4 is a perspective view of another example embodiment of a solid core table or desk made of artificial board substrates having decorative sheets laminated on their outer surfaces in accordance with the prior art;

FIG. 5 is a partial exploded perspective view of a butt joint of the prior art furniture articles of FIGS. 3 and 4;

FIG. 6 is a partial exploded perspective view of a solid core main panel or side panel of the prior art furniture articles of FIGS. 3 and 4;

DETAILED DESCRIPTION

Figure 7:
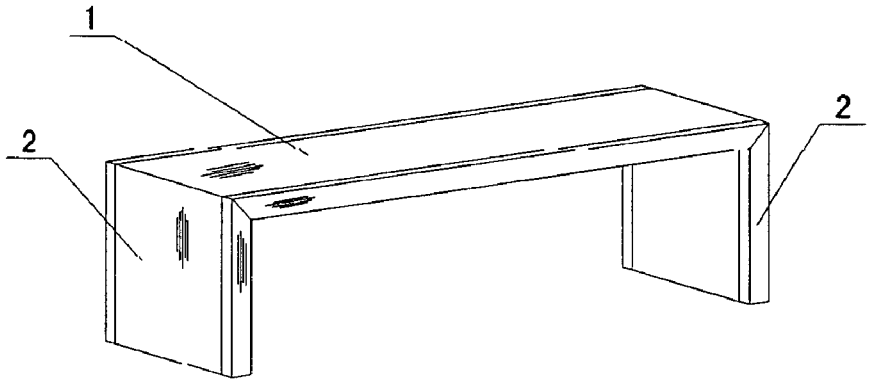
FIG. 7 is a perspective view of an example embodiment of a hollow core table or desk made of wood or engineered bamboo in accordance with the present invention.

The present invention is described in detail below in the context of a table or desk as an example embodiment. However, as those of skill in the art will understand, the instant teachings can also be applied to other types of furniture articles, as well. Referring to FIG. 7, a hollow core, glue-laminated (gluelam) wood or engineered bamboo article of furniture includes a main panel 1 and a pair of side panels 2 having upper ends respectively connected to opposite ends of the main panel 1.

Referring to FIGS. 8 to 11, the main panel 1 includes a main framework 11, an upper plate 12 having front and rear edges respectively disposed on corresponding front and rear ledges 1115 formed in an upper surface of the main framework 11, and a lower plate 13 having front and rear edges respectively disposed on corresponding front and rear ledges 1116 formed in a lower surface of the main framework 11.

Figure 10:
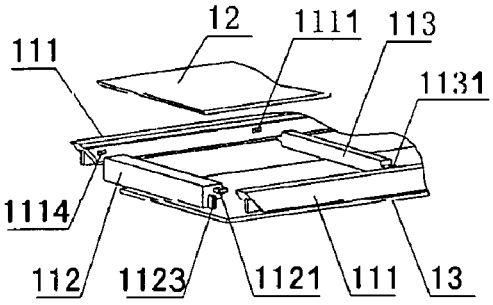
FIG. 10 is a partial exploded section view of the main panel of FIG. 8.
Figure 11:
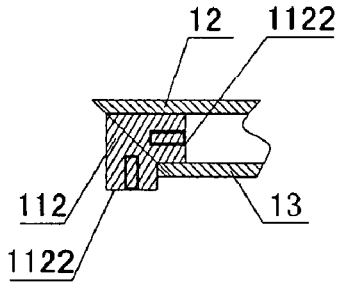
FIG. 11 is a partial cross-sectional view of the main panel of FIG. 8, as seen along the lines of the section B-B taken therein.

As illustrated in FIGS. 8 to 11, the main framework 11 comprises a rectangular frame formed by connecting opposite ends of a pair of elongated transverse frame borders 111 to corresponding opposite ends of a pair of elongated longitudinal frame borders 112, each of which has an L-shaped cross-section defining a pair of orthogonal vertical and horizontal legs 1122, as illustrated in FIG. 11. The main framework 11 additionally includes at least one elongated longitudinal intermediate support beam 113 extending orthogonally between the two transverse frame borders 111 intermediate of their respective opposite ends. As illustrated in FIG. 10, the at least one support beam 113 has opposite ends respectively connected to corresponding ones of the transverse frame borders 111, e.g., with respective mortise 1111 and tenon 1131 joints. As will be appreciated, the main framework 11 can include two or even more longitudinal support beams 113 when a longer main panel 1 is contemplated.

Figure 12:
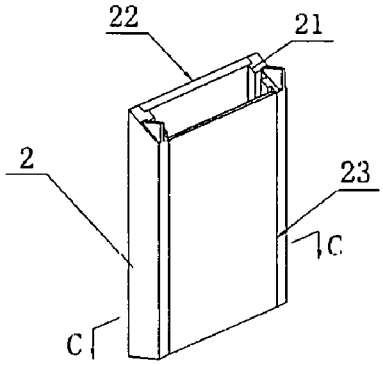
FIG. 12 is a perspective view of a side panel of the example furniture article of FIG. 7.
Figure 13:
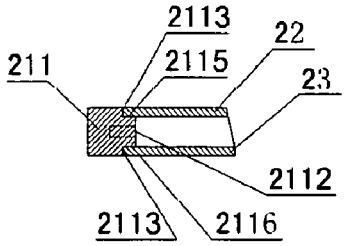
FIG. 13 is a partial cross-sectional view of the side panel of FIG. 12, as seen along the lines of the section C-C taken therein; and, FIG. 14 is an exploded perspective view of the side panel of FIG. 12.
Figure 14:
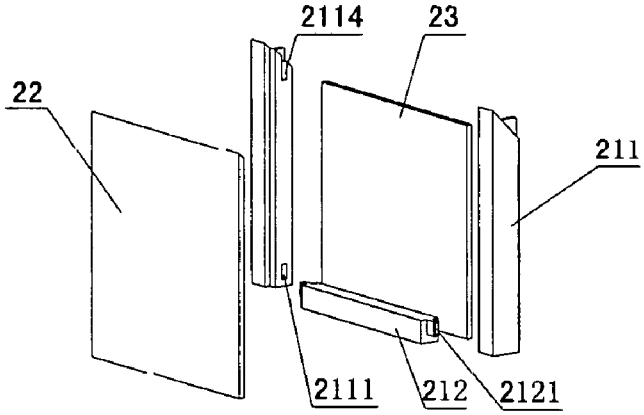

Referring to FIGS. 12 to 14, each of the side panels 2 includes a side framework 21, an outer support plate 22 having front and rear edges respectively disposed on corresponding outer ledges 2115 formed in an outer surface of the side framework 21, and an inner support plate 23 having front and rear edges respectively disposed on corresponding inner ledges 2116 formed in an inner surface of the side framework 21. The side framework 21 comprises a U-shaped frame that is formed by connecting respective lower ends of a pair of elongated vertical frame borders 211 to corresponding opposite ends of an elongated longitudinal lower frame border 212.

Figure 8:
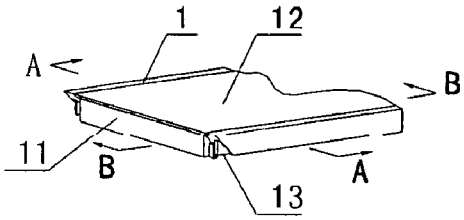
FIG. 8 is a partial perspective view of a main panel of the example furniture article of FIG. 7.
Figure 9:
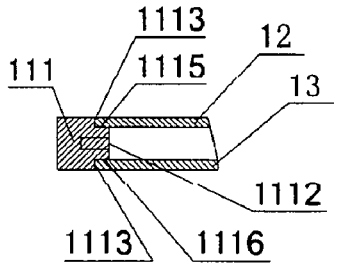
FIG. 9 is a partial cross-sectional view of the main panel of FIG. 8, as seen along the lines of the section A-A taken therein.

As illustrated in FIGS. 8 and 10, each of the opposite ends of each of the transverse frame borders 111 is sloped at a 45 degree angle and includes a mortise with a tenon 13 extending therefrom. As illustrated in FIGS. 12 and 14, each of the vertical frame borders 211 includes an upper end that is sloped at an angle corresponding to the angle on a corresponding end of a corresponding one of the transverse frame borders 111 and includes a mortise into which the tenon 13 at the corresponding end of the corresponding transverse frame border 111 extends.

Similarly, as illustrated in FIGS. 10, 11 and 14, each of the opposite ends of each of the L-shaped longitudinal frame borders 112 includes a pair of mortises, each having a respective tenon 1121 and 1123 extending therefrom. The tenons 1121 and 1123, in turn, respectively extend into corresponding mortises 1114 and 2114 respectively formed in the sides of the transverse frame borders 111 at the opposite ends thereof, and in the sides of the vertical frame borders 211 at the upper ends thereof.

Likewise, as illustrated in FIG. 14, each of the opposite ends of the longitudinal lower frame borders 212 includes a mortise having a tenon 2121 extending therefrom. The tenons 2121, in turn, respectively extend into corresponding mortises 2111 respectively formed in the sides of the vertical frame borders 211 at the lower ends thereof.

As illustrated in FIG. 10, tenons 1131 respectively protrude from corresponding mortises at each of the opposite ends of the at least one longitudinal support beam 113, and these tenons 1131 respectively extend into corresponding mortises 1111 formed in the transverse frame borders 111.

During the assembly of the main panel 1 of the furniture article, each of the corresponding mortises and tenons of the main framework 11 are bonded to each other first using an environmentally friendly, high-strength adhesive. Then, the upper plate 12, which has a horizontal length substantially equal to the length of the respective upper surfaces of the transverse frame borders 111, is bonded onto the upper surface of a rectangular "frame" defined by the front and rear ledges 1115 of the transverse frame borders 111 and the longitudinal frame borders 112 using the adhesive. In a similar manner, the lower plate 13, which has a horizontal length substantially equal to the transverse distance between respective inner surfaces of the vertical legs of the L-shaped longitudinal frame borders 112, is bonded onto the lower surface of a rectangular frame defined by the front and rear ledges 1116 of the transverse frame borders 111 and the respective lower surfaces of the horizontal legs of the L-shaped longitudinal frame borders 112.

Referring to FIG. 14, in a similar manner, to assemble the side panels 2, the tenons 2121 of the bottom frame borders 212 are first bonded into the corresponding mortises 2111 of the corresponding vertical frame borders 211 so as to form the two U-shaped side frameworks 21. Then, the outer support plates 22, which have a vertical length substantially equal to the length of the outer surfaces of the vertical frame borders 211, are respectively bonded onto the respective outer ledges 2115 of the two vertical frame borders 211. The inner support plates 23, which have a vertical length substantially equal to the vertical distance between the lower end of the vertical frame borders 211 and a lower surface of the upper plate 12, are respectively bonded onto the inner ledges 2116 of the vertical frame borders 211.

As described above with reference to FIGS. 12 and 14, the vertical frame borders 211 have an upper, or "junction" end that is sloped at 45 degrees, and that include mortise and tenon joints corresponding to those at the opposite "junction" ends of the main panel 1. The side panels 2 are connected to the main panel 1 by connecting the corresponding mortises and tenons of the respective junction ends of the vertical frame borders 211 to the corresponding junction ends of the transverse frame borders 111. Thus, the sloped upper ends of the two vertical frame borders 211 of each side panel 2 are connected to the corresponding sloped ends of the transverse frame borders 111 by bonding the corresponding mortises and tenon joints thereat with an adhesive. Meanwhile, the tenons 1123 on the opposite ends of the L-shaped longitudinal frame borders 112 are correspondingly bonded into the mortises 2114 of the transverse frame borders 111 and the vertical frame borders 211.

Additionally, as illustrated in FIGS. 7 and 11, the opposite ends of the upper plate 12 respectively join corresponding upper ends of the outer support plates 22 in a 90 degree miter joint. During assembly of the side panels 2 to the main panel 1, the upper ends of the outer support plates 22 are bonded to the respective lateral surfaces of the respective vertical legs of the L-shaped longitudinal frame borders 112 with an adhesive.

As those of skill in the art will understand, the dimensional configuration of the various components can be widely varied, depending on the particular application at hand. For example, with reference to FIGS. 9, 11 and 13, in one possible embodiment, the thickness 1112 of the transverse frame borders 111 between the ledges 1115 and 1116 on the upper and lower surfaces of the main framework 11, the thickness 2112 of the vertical frame borders 211 between the ledges 2115 and 2116 on the inner and outer surfaces of the side framework 21, and the thickness 1122 of each of the orthogonal legs of the L-shaped longitudinal frame borders 112 may be substantially the same.

In another embodiment, the respective thicknesses of the upper plate 12, the lower plate 13, the outer support plates 22 and the inner support plates 23 may all be substantially the same.

In yet another embodiment, an upper surface of the upper plate 12 may be made substantially flush with the upper surfaces of the transverse frame borders 111, and the respective outer surfaces of the outer support plates 22 may be made substantially flush with outer surfaces of corresponding ones of the vertical frame borders 211.

As will be evident from the above description, the components of the hollow core furniture articles of the present invention, whether of conventional or gluelam bamboo lumber, can be made relatively thin without sacrificing the strength of the article, which results in lighter weight furniture and enables an efficient use of construction materials. If gluelam bamboo timber is used, the resulting furniture is light in weight, convenient for moving, and has a pleasing aesthetic appearance. Because of the hollow core structure incorporating plates bonded on each of the surfaces thereof, the main panel 1 and side panels 2 are effectively free of warping, so that the furniture is both durable and practical.

Compared with solid core prior art furniture, the hollow core furniture articles of the present invention provide a number of distinct advantages:

The present furniture articles use main panels and side panels with a hollow core construction, which results in a large saving in construction materials, thereby reducing costs and resulting in furniture that is light and easy to move, yet strong and robust.

The present furniture articles uses a frame-type construction with plates bonded on each surface of the articles, which prevents the main panels and side panels from warping.

The present furniture articles are assembled by bonding tenons into mortises with high-strength, environmentally friendly adhesives, so that the assembled structures are rigid, durable and practical.

By now, those of skill in this art will appreciate that many modifications, substitutions and variations can be made in and to the materials, apparatus, configurations and methods of the novel hollow core furniture articles of the present disclosure without departing from its scope. Accordingly, the scope of the present disclosure should not be limited to the particular embodiments illustrated and described herein, as they are merely by way of some examples thereof, but instead, should be fully commensurate with that of the claims appended hereafter and their functional equivalents.

What is claimed is:

1. A hollow core article of furniture, comprising:

a main panel (1); and, a pair of side panels (2) having upper ends respectively connected to opposite ends of the main panel (1), wherein:

the main panel (1) includes a main framework (11), an upper plate (12) having front and rear edges respectively disposed on corresponding front and rear ledges (1115) on an upper surface of the main framework (11), and a lower plate (13) having front and rear edges respectively disposed on corresponding front and rear ledges (1116) on a lower surface of the main framework (11); and, each of the side panels (2) includes a side framework (21), an outer support plate (22) having front and rear edges respectively disposed on corresponding ledges (2115) on an outer surface of the side framework (21), and an inner support plate (23) having front and rear edges respectively disposed on corresponding front and rear ledges (2116) on an inner surface of the side framework (21) a rectangular frame formed by connecting opposite ends of a pair of elongated transverse frame borders (111) to corresponding opposite ends of a pair of elongated longitudinal frame borders (112), each having an L-shaped cross-section defining a pair of orthogonal vertical and horizontal legs (1122); and, at least one elongated longitudinal support beam (113) extending orthogonally between the two transverse frame borders (111) intermediate of their opposite ends, the at least one support beam (113) having opposite ends respectively connected to corresponding ones of the transverse frame borders (111); and, each of the side frameworks (21) comprises a U-shaped frame formed by connecting respective lower ends of a pair of elongated vertical frame borders (211) to corresponding opposite ends of an elongated longitudinal lower frame border (212);

each of the opposite ends of each of the transverse frame borders (111) is sloped at a 45 degree angle and includes a mortise with a tenon extending therefrom;

each of the vertical frame borders (211) includes an upper end that is sloped at an angle corresponding to the angle on a corresponding end of a corresponding one of the transverse frame borders (111) and includes a mortise into which the tenon at the corresponding end of the corresponding transverse frame border (111) extends;

each of the opposite ends of each of the L-shaped longitudinal frame borders (112) includes a pair of mortises, each having a respective tenon (1121) and (1123)

extending therefrom, the tenons (1121) and (1123) respectively extending into corresponding mortises (1114) and (2114) respectively formed in the sides of the transverse frame borders (111) at the opposite ends thereof and in the sides of the vertical frame borders (211) at the upper ends thereof; and, each of the opposite ends of the longitudinal lower frame border (212) includes a mortise having a tenon (2121) extending therefrom, each of the tenons (2121) respectively extending into corresponding mortises (2111) respectively formed in the sides of the vertical frame borders (211) at the lower ends thereof.

2. The furniture article of claim 1, wherein a thickness (1112) of the transverse frame borders (111) between the ledges (1115) and (1116) on the upper and lower surfaces of the main framework (11), a thickness (2112) of the vertical frame borders (211) between the ledges (2115) and (2116) on the inner and outer surfaces of the side framework (21), and a thickness (1122) of each of the orthogonal legs of the L-shaped longitudinal frame borders (112) are substantially the same.

3. The furniture article of claim 2, wherein:

the upper plate (12) has a horizontal length substantially equal to the length of the transverse frame borders (111);

the outer support plates (22) have a vertical length substantially equal to the length of the vertical frame borders (211);

the bottom plate (13) has a horizontal length substantially equal to a transverse distance between respective inner surfaces of the vertical legs of the L-shaped longitudinal frame borders (112); and, the inner support plates (23) have a vertical length substantially equal to a vertical distance between the lower end of the vertical frame borders (211) and a lower surface of the upper plate (12).

4. The furniture article of claim 3, wherein the respective thicknesses of the upper plate (12), the lower plate (13), the outer support plates (22) and the inner support plates (23) are substantially the same.

5. The furniture article of claim 4, wherein:

an upper surface of the upper plate (12) is substantially flush with upper surfaces of the transverse frame borders (111); and, respective outer surfaces of the outer support plates (22) are substantially flush with outer surfaces of corresponding ones of the vertical frame borders (211).

6. The furniture article of claim 4, wherein opposite ends of the upper plate (12) respectively join corresponding upper ends of the outer support plates (22) in a 90 degree miter joint.

7. The furniture article of claim 5, wherein opposite ends of the upper plate (12) respectively join corresponding upper ends of the outer support plates (22) in a 45 degree miter joint.

8. The furniture article of claim 1, wherein at least the upper plate (12), the lower plate (13), and the outer and inner support plates (22) and (23) are made of flat pressed or side pressed glue-laminated bamboo boards.

* * * * *